US012108820B2

(12) United States Patent
Tang

(10) Patent No.: US 12,108,820 B2
(45) Date of Patent: Oct. 8, 2024

(54) GLOVE

(71) Applicant: Xiaohui Tang, Shanghai (CN)

(72) Inventor: Xiaohui Tang, Shanghai (CN)

( * ) Notice: Subject to any disclaimer, the term of this patent is extended or adjusted under 35 U.S.C. 154(b) by 0 days.

(21) Appl. No.: 18/432,032

(22) Filed: Feb. 4, 2024

(65) Prior Publication Data

US 2024/0172821 A1 May 30, 2024

Related U.S. Application Data

(63) Continuation of application No. PCT/CN2021/138986, filed on Dec. 17, 2021.

(30) Foreign Application Priority Data

Oct. 8, 2021 (CN) ..... 202122423032.0

(51) Int. Cl.
*A41D 19/015* (2006.01)
*A41D 19/02* (2006.01)

(52) U.S. Cl.
CPC ..... *A41D 19/02* (2013.01)

(58) Field of Classification Search
CPC ..... A41D 19/02; A41D 19/0086; A41D 19/01517; A41D 19/01547; A41D 19/015; A41D 2300/50
USPC ..... 2/163, 165
See application file for complete search history.

(56) References Cited

U.S. PATENT DOCUMENTS 1,239,255 A * 9/1917 Burroughs ..... A41D 19/00 2/163
1,377,338 A * 5/1921 Grinnell ..... A41D 19/02 2/169
5,231,700 A * 8/1993 Cutshall ..... A61B 42/10 2/167
7,287,285 B2 * 10/2007 Jaeger ..... A41D 27/24 2/161.1

* cited by examiner

*Primary Examiner* — Tajash D Patel

(57) ABSTRACT

A glove includes: first palm pieces at fingertips of the glove and rear side pieces at the fingertips of the glove; the first palm piece and the rear side piece are integrally formed; each of the first palm piece and the rear side piece is sewn together at one end of their respective finger parts to form a three-dimensional structure, seams between the first palm pieces and the rear side pieces are provided on nails or on backs of fingers. The present disclosure includes a complete piece that fully encloses the fingertips formed integrally by the first palm piece and the rear side piece, and makes the sewn part of the first palm piece and the rear side piece from the fingertips to the back of the fingers.

9 Claims, 15 Drawing Sheets

GLOVE

TECHNICAL FIELD

The present disclosure belongs to the technical field of gloves, specifically involving a type of glove.

BACKGROUND

The structure of gloves has seen almost no changes throughout history. Most gloves on the market still connect the palm part to the back through the use of finger strips/spokes, much like they did thousands of years ago. The fingers of the gloves are connected to the palm and back by seams at the fingertips, the sides of each finger, and the crotch between each finger.

The problem with traditional glove designs is reduced sensitivity because the materials of typical gloves are joined together at the fingertips, which is the most sensitive part of the human hands when performing high-performance tasks. The wearer's nails are prone to catching on the seams, reducing the practicality and flexibility of the gloves. Seams in the central area of wear and tear can lead to material degradation of the gloves. The presence of multiple materials and seams reduces comfort when wearing them; multiple seams and materials increase the likelihood of the gloves getting caught on external objects such as nails and screws. Due to the thinner and lighter palm materials used in traditional gloves, nails are easily damaged.

Referring to FIGS. 1 and 2, these depict a view of the typical glove structure 10 in the prior art. The palm piece 10 has a thumb part 12 and finger parts 14*a*, 14*b*, 14*c*, and 14*d*, along with a corresponding back piece 22. Edge strips/spokes 16 are typically provided on the sides of the index finger 14*a*, middle finger 14*b*, ring finger 14*c*, and little finger 14*d*. As shown in FIG. 2, the palm material 20 and the back spandex material 22 are sewn together by seam line 24, forming a horizontal seam at the top of the fingertips, which can cause discomfort for the glove wearer. Here, P1 refers to the palm part of the glove fingertips; P2 refers to the rear side piece of the glove fingertips; P3 and P4 refer to the two side pieces of the glove fingertips. Now referring to FIGS. 5 and 6, these show a top view and a side view of the fingertips of the classic glove structure. From FIGS. 5 and 6, it can be seen that the fingertips of the classic glove are sewn together from four pieces of material at the top of the fingertips.

FIGS. 3 and 4 illustrate the glove structure of FIG. 1 flipped inside out, showing the palm material 20, back spandex material 22, and finger sheath 16 sewn together by seam line 24.

In U.S. Patent US54090290A, Mr. Danny Gold upgraded the structure of the classic glove to a three-piece fingertip as shown in FIGS. 7 and 8, making it smoother. In FIGS. 7 and 8, Mr. Danny Gold combined P3 and P4 into one piece, successfully reducing half of the seaming structure. In U.S. Patent U.S. Pat. No. 7,287,285B2, Mr. Eric M. Jagger and his colleagues made similar improvements by extending P1 to P2, resulting in a three-piece fingertip structure as depicted in FIGS. 9 and 10. Their invention improved the durability of the gloves, similar to Mr. Danny Gold's invention, as the palm material is the most durable and serves the most significant function in practice.

SUMMARY

To address the drawbacks of the existing technology, the present disclosure seeks to provide a glove that enhances wearer comfort, enables users to grasp various types of objects, and increases the protection offered by the glove.

In order to address the aforementioned technical problems, the present disclosure provides the following technical solutions:

The present disclosure presents a glove, comprising: a plurality of first palm pieces at fingertips of the glove and a plurality of rear side pieces at the fingertips of the glove; each first palm piece and each rear side piece are integrally formed;

each first palm piece and each rear side piece are sewn together at ends of their respective finger parts to form a three-dimensional structure, wherein each seam between each first palm piece and each rear side piece is provided on a nail or on a back of each finger.

Optionally, in the above glove, wherein the set width of the first palm piece is at least the sum of the width of the back of the glove finger plus the width of the two fingers' sides.

Optionally, in the above glove, further comprising: a plurality of first back seam pieces at the fingertips, wherein the first back seam piece is also sewn together with the first palm piece and the rear side piece, respectively.

Optionally, in the above glove, wherein a set length of the first palm piece is greater than that of the first back seam piece, and a set width of the first palm piece is greater than that of the first back seam piece.

Optionally, in the above glove, wherein a seam line of the first back seam piece with the first palm piece and a seam line of the first back seam piece with the rear side piece are both provided on the backs of the fingers.

Optionally, in the above glove, wherein the first back seam piece is made of stretchable material.

Optionally, in the above glove, further comprising: a second palm piece extending to a palm part, wherein the second palm piece is connected to the first palm piece.

Optionally, in the above glove, wherein the second palm piece and the first palm piece are integrally formed.

Optionally, in the above glove, further comprising: a second back seam piece extending to a back of a hand, wherein the second back seam piece is connected to the first back seam piece.

Optionally, in the above glove, wherein the first back seam piece and the second back seam piece are integrally formed.

Optionally, in the above glove, further comprising: a plurality of edge strips provided adjacent to a finger fork of the glove.

Optionally, in the above glove, wherein the first palm piece and the rear side piece are sewn into a surrounding piece provided around the fingertips, wherein an unfold member of the surrounding piece has a bottle-like shape.

Optionally, in the above glove, wherein the first palm piece has a first width at a position separated from the fingertips; a second width at a part corresponding to positions of the fingertips, where the second width is smaller than the first width; and a third width on the rear side piece at a position separated from the fingertips, where the third width is smaller than the first width.

Compared to the prior art, the present disclosure has the following technical effects:

The present disclosure provides a glove structure that includes a complete piece that fully encloses the fingertips, and is formed integrally by the first palm piece and the rear side piece, making the sewn part of the first palm piece and the rear side piece from the fingertips move to the back of the fingers.

The present disclosure features a glove structure that fully encloses the fingertip part, eliminating the bulky seam edges on the fingertips in work gloves and sports gloves, allowing the piece to smoothly fit the "operating surface" of the entire fingertips, ultimately increasing the sensitivity of the fingers. This increased sensitivity makes the gloves more comfortable and practical compared to the prior art. Users can pick up smaller items, such as coins, nails, screws, buttons or the like, and also have a higher sensitivity to the smoothness and roughness of the contact environment. The "operating surface" mentioned above refers to the three most commonly used surfaces on the fingertips, corresponding to the side of the fingertips with nails and hair.

Since a complete piece of material wraps around the distal end of the fingers (i.e., the fingertips), no seams are presented within the entire "operating surface" of the fingertips, and the glove material is only seamed on the back of the fingers. For high-performance glove users, only one layer of protective material is provided between the sensitive finger skin and the target or tool being operated. This fully enclosed design provides a completely natural fit for the shape of the user's hands.

Additionally, as all the material connection points have been moved to the back of the fingers, i.e., the seam edges of the material can provide reinforced protection for the nails, resulting in a comfortable wearing experience to prevent impact, puncture, and cutting accidents, or the like.

BRIEF DESCRIPTION OF DRAWINGS

By reading the detailed description of non-limiting embodiments with reference to the figures, other features, objectives, and advantages of the present disclosure will become more apparent.

DESCRIPTION OF EMBODIMENTS

The following will combine the figures in the embodiments of the present disclosure to clearly and completely describe the technical solutions in the embodiments according to the present disclosure. It is obvious that the described embodiments are only part of the embodiments of the present disclosure, not all of them. Based on the embodiments in the present disclosure, all other embodiments obtained by those skilled in the art in this field without any inventive efforts are within the protection scope of the present disclosure.

As shown in FIGS. 11 to 19, in one of the embodiments according to the present disclosure, a glove is provided, comprising a plurality of first palm pieces P1 at the fingertips of the glove and a plurality of rear side piece P2 at the fingertips of the glove. Each first palm piece P1 and each rear side piece P2 are integrally formed.

Each first palm piece P1 and each rear side piece P2 are sewn together at the end of their respective finger parts to form a three-dimensional structure, where each seam between each first palm piece P1 and each rear side piece P2 is provided on each nail or on each back of the finger.

The embodiment includes a complete piece that fully encloses the fingertips, which is formed integrally by the first palm pieces P1 and rear side pieces P2, and makes the sewn part of the first palm piece P1 and the rear side piece P2 move from the fingertips to the backs of the fingers. Wherein, the glove structure with complete enclosure at the fingertips completely eliminates the bulky seam edges on the fingertips in work gloves and sports gloves, allowing the piece to smoothly fit the "operating surface" of the entire fingertips, thereby increasing the sensitivity of the fingers. This increased sensitivity makes the gloves more comfortable and practical compared to gloves in the prior art. Users can pick up smaller items, such as coins, nails, screws, buttons, or the like, and also have a higher sensitivity to the smoothness and roughness of the contact environment. The "operating surface" mentioned refers to the three most commonly used surfaces on the fingertips, corresponding to the side of the fingertips with nails and hair.

In the embodiment, no additional separate material strip needs to be connected to the back of the glove. The glove in the embodiment has an opening to receive the wearer's hand. Wherein the first palm piece P1 and the rear side piece P2 each have an inner surface, where the wearer's hand contacts the inner surface of the first palm piece P1 and the rear side piece P2 when inserted into the opening.

The set width of the first palm piece P1 is at least the sum of the set width of the back of the glove finger and the width of the two sides of the fingers. Therefore, in the embodiment, the seam with the material of the back of the glove will only be provided on the back of the glove finger, and no seams are presented on both sides of the glove finger.

Figure 1:
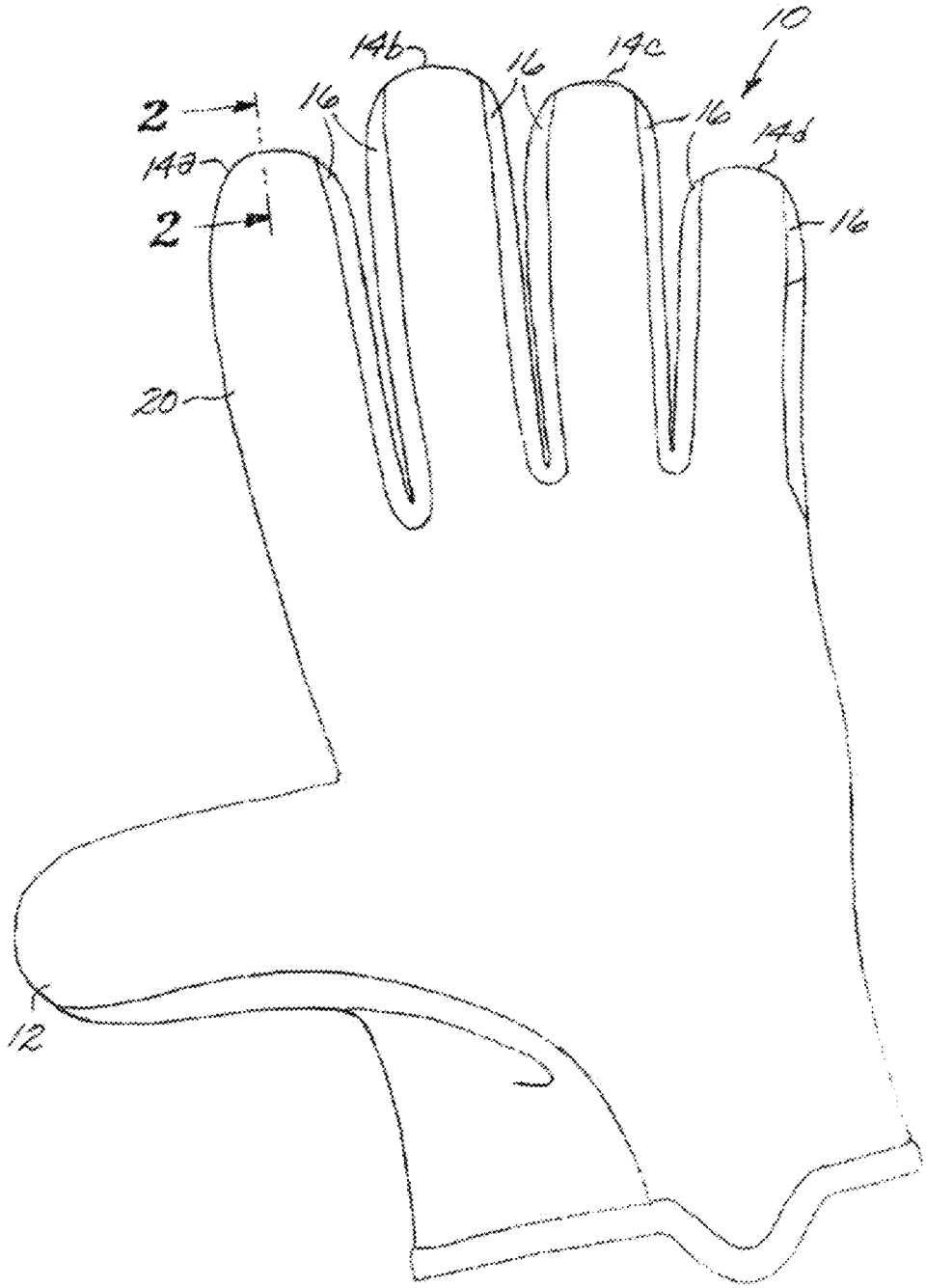
FIG. 1 is a view of a palm part of the glove configuration of the classic structure.
Figure 2:
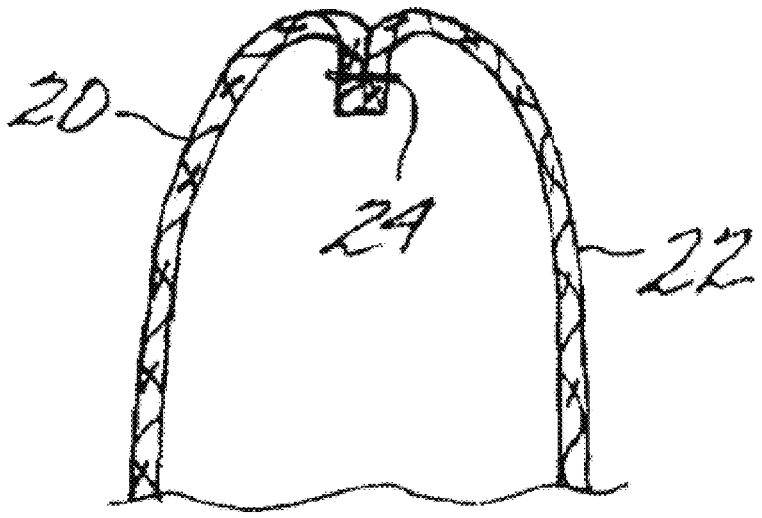
FIG. 2 is a sectional view along line 2-2 of FIG. 1.
Figure 3:
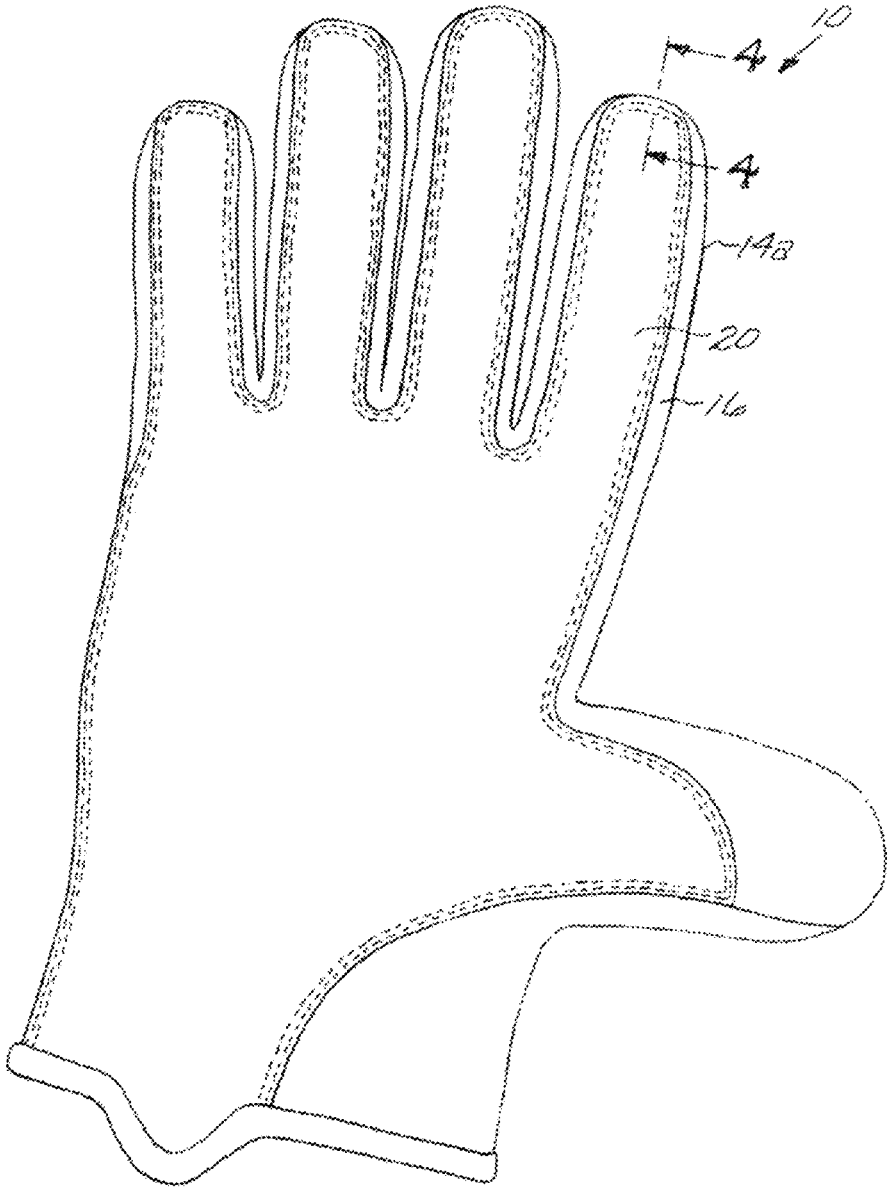
FIG. 3 is an inside-out view of the glove structure shown in FIG. 1.
Figure 4:
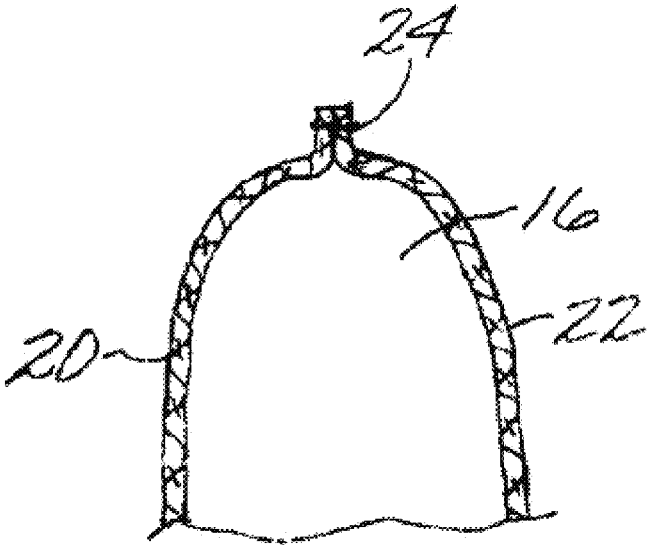
FIG. 4 is a sectional view along line 4-4 of FIG. 3.
Figure 5:
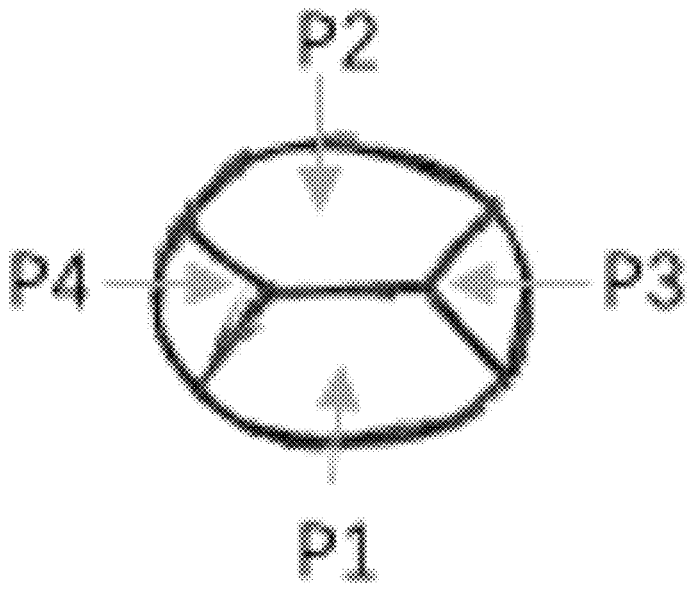
FIG. 5 is a top view of fingertips of a glove designed in a classic manner.
Figure 6:
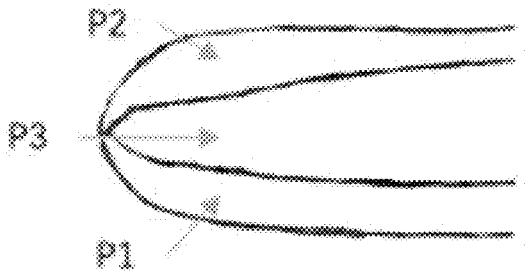
FIG. 6 is a side view of the fingertips of the glove as in FIG. 5.
Figure 7:
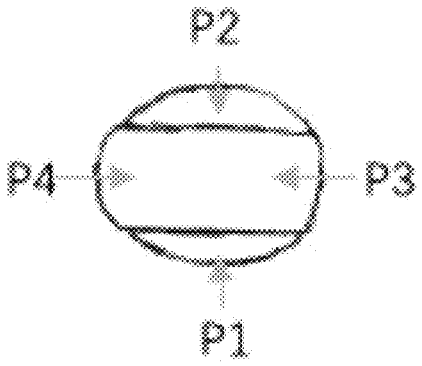
FIG. 7 is a top view of the fingertips of a glove disclosed in U.S. Patent U.S. Pat. No. 5,490,290A.
Figure 8:
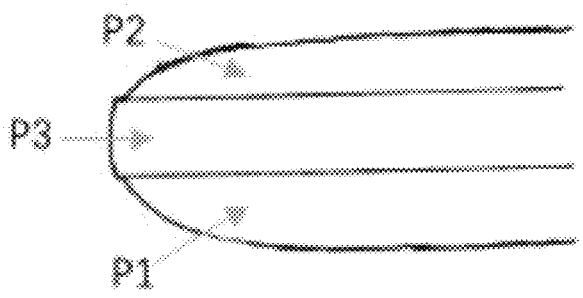
FIG. 8 is a side view of the fingertips of the glove as in FIG. 7.
Figure 9:
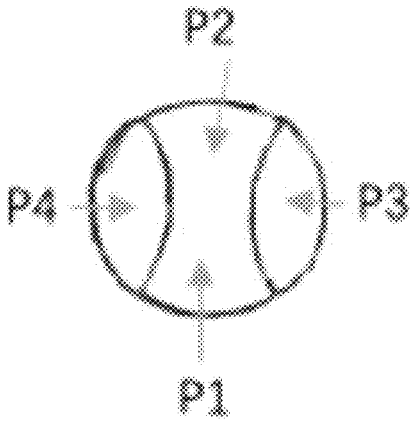
FIG. 9 is a top view of the fingertips of a glove disclosed in U.S. Patent U.S. Pat. No. 7,287,285B2.
Figure 10:
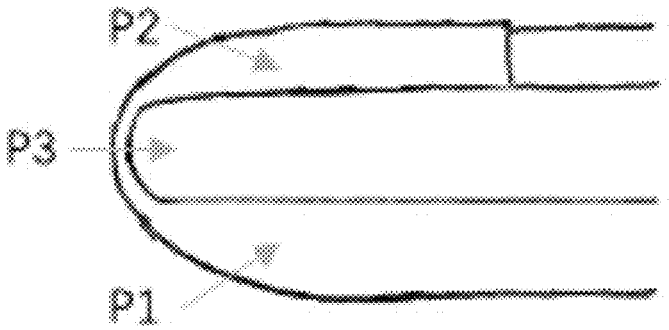
FIG. 10 is a side view of the fingertips of the glove as in FIG. 9.
Figure 11:
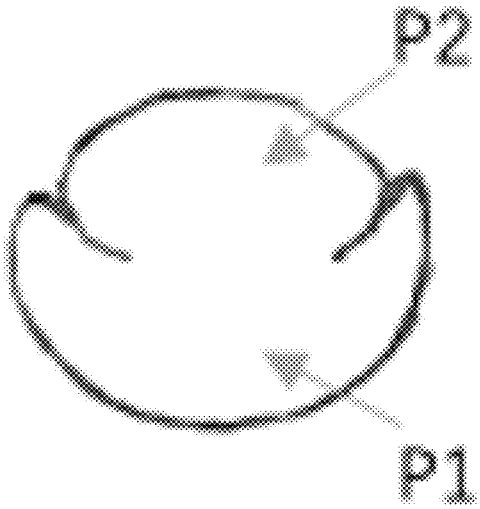
FIG. 11 is a top view of a fingertip of a glove in one embodiment according to the present disclosure.
Figure 12:
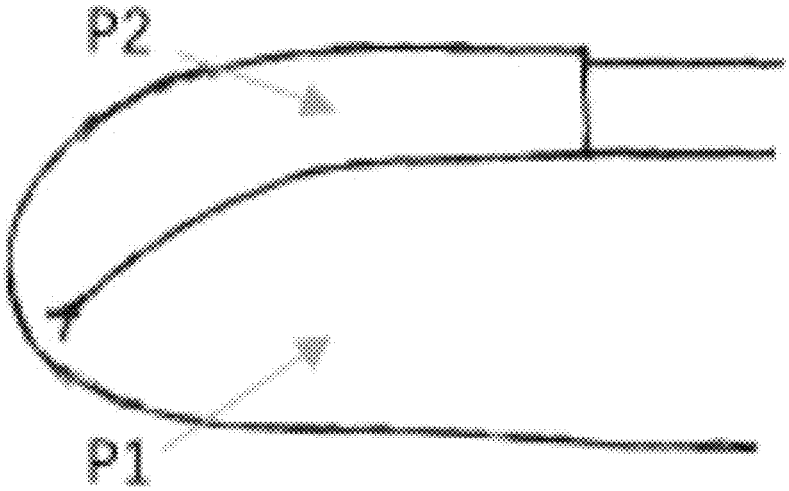
FIG. 12 is a side view of one fingertip of the glove as in FIG. 11.
Figure 13:
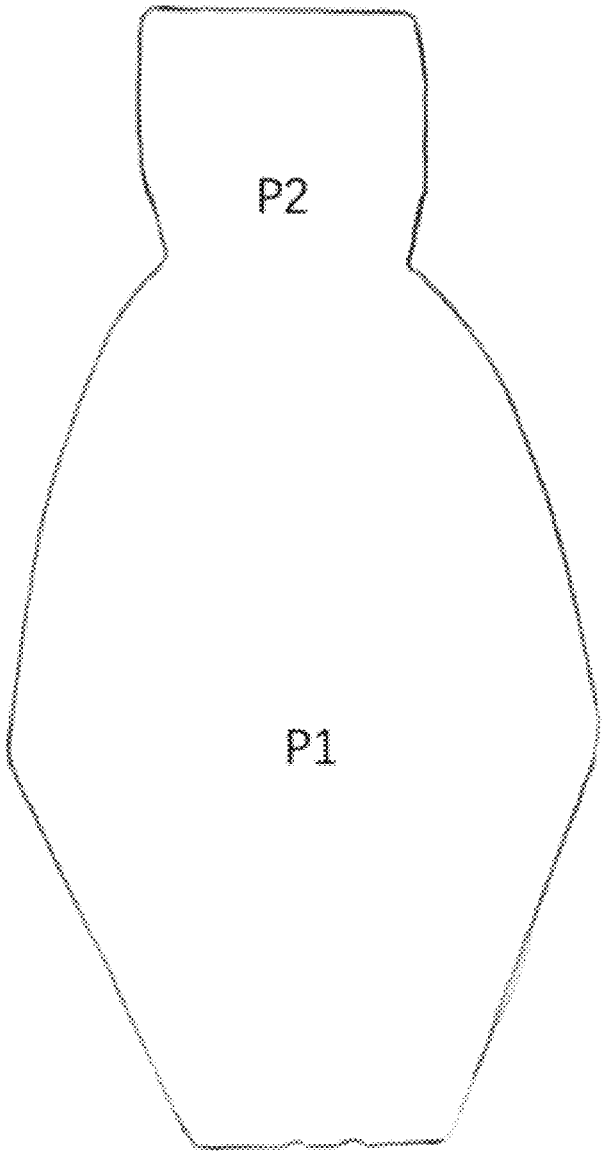
FIG. 13 is a structural diagram of a palm piece of the glove fingertip in one embodiment according to the present disclosure.
Figure 14:
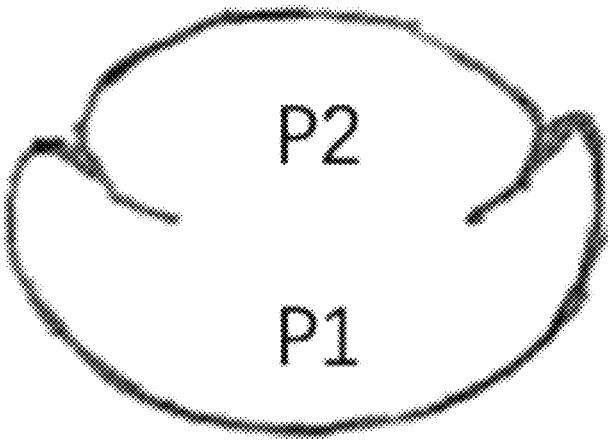
FIG. 14 is a top view of the glove fingertip after being sewn with the material as shown in FIG. 13.
Figure 15:
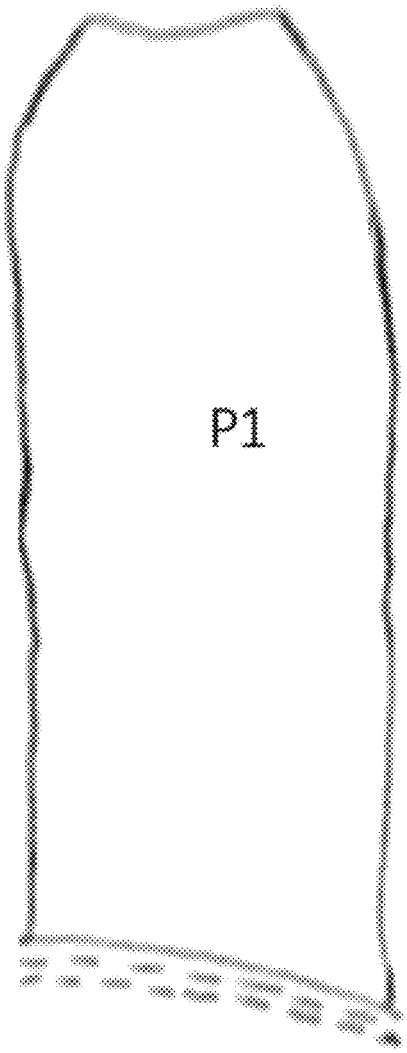
FIG. 15 is a palm view of the glove fingertip as shown in FIG. 13 after sewing from the material.

As shown in FIG. 13, in the embodiment, the first palm piece P1 and the rear side piece P2 are sewn into a surrounding piece surrounding the fingertips, where the unfold member of the surrounding piece has a bottle-like shape. The surrounding piece includes: a first width on the first palm piece P1 at a position separated from the fingertip; a second width at a part corresponding a position at the fingertips, where the second width is smaller than the first width; and a third width on the rear side piece P2 at a position separated from the fingertip, where the third width is substantially smaller than the first width. The mentioned first width, second width, and third width preferably refer to the average width of the corresponding parts of the surrounding piece.

Figure 16:
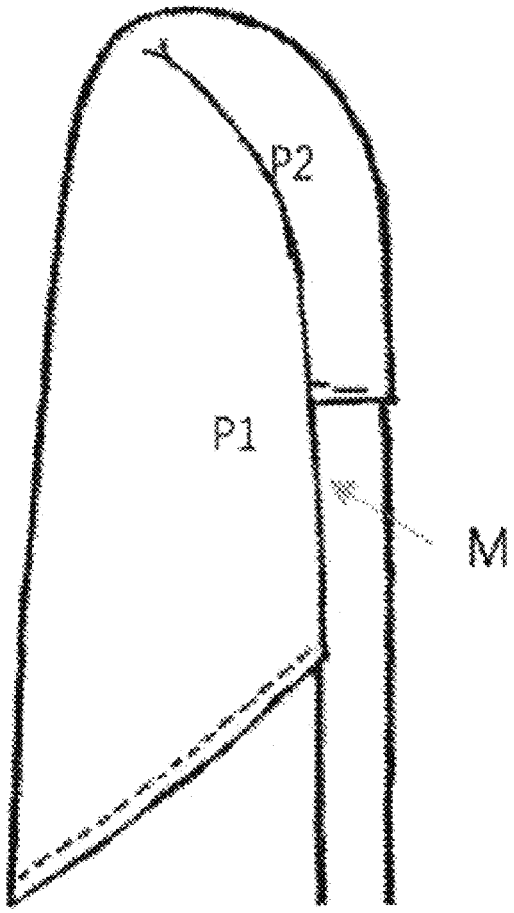
FIG. 16 is one of side views of the glove fingertip as shown in FIG. 13 after sewing.
Figure 17:
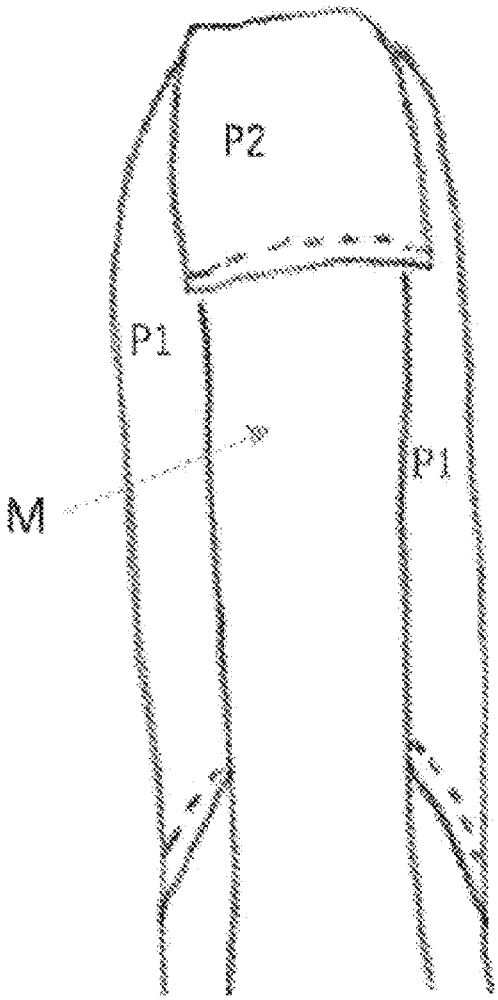
FIG. 17 is a back view of the glove fingertip as shown in FIG. 13 after sewing.

Furthermore, as shown in FIGS. 16 and 17, the embodiment also includes a plurality of first back seam pieces (M) at the fingertips, where each first back seam piece (M) is also sewn together with the first palm piece P1 and the rear side piece P2.

Wherein, in the embodiment, the set length of the first palm piece P1 is greater than that of the first back seam piece (M), and the set width of the first palm piece P1 is greater than that of the first back seam piece (M). This setting further ensures that the seam between the first palm piece P1 and the first back seam piece (M) is provided on the nail or on the back of the finger.

Optionally, each seam line of the first back seam piece (M) with the first palm piece P1 and each seam line of the first back seam piece (M) with the rear side piece P2 are all provided on the back of each finger. Because a complete piece of material wraps around the distal end (i.e., the fingertip) of the finger, no seams are presented within the entire "operating surface" of the fingertips; the glove material is only sewn on the back of the finger. For high-performance glove users, only one layer of protective material is presented between the sensitive finger skin and the operating target or tool. This fully enclosing design provides a completely natural fit for the user's hands. As all the material connection points have been moved to the back of the fingers, the seam edges of the material can provide enhanced protection for the nails at the fingertips, providing a comfortable wearing experience to prevent impacts, punctures, and cutting accidents, and the like.

Further preferably, in the embodiment, the first back seam piece (M) is made of stretchable material, which further ensures a better fit of the glove to the fingers, thereby enhancing the comfort of wear.

Figure 18:
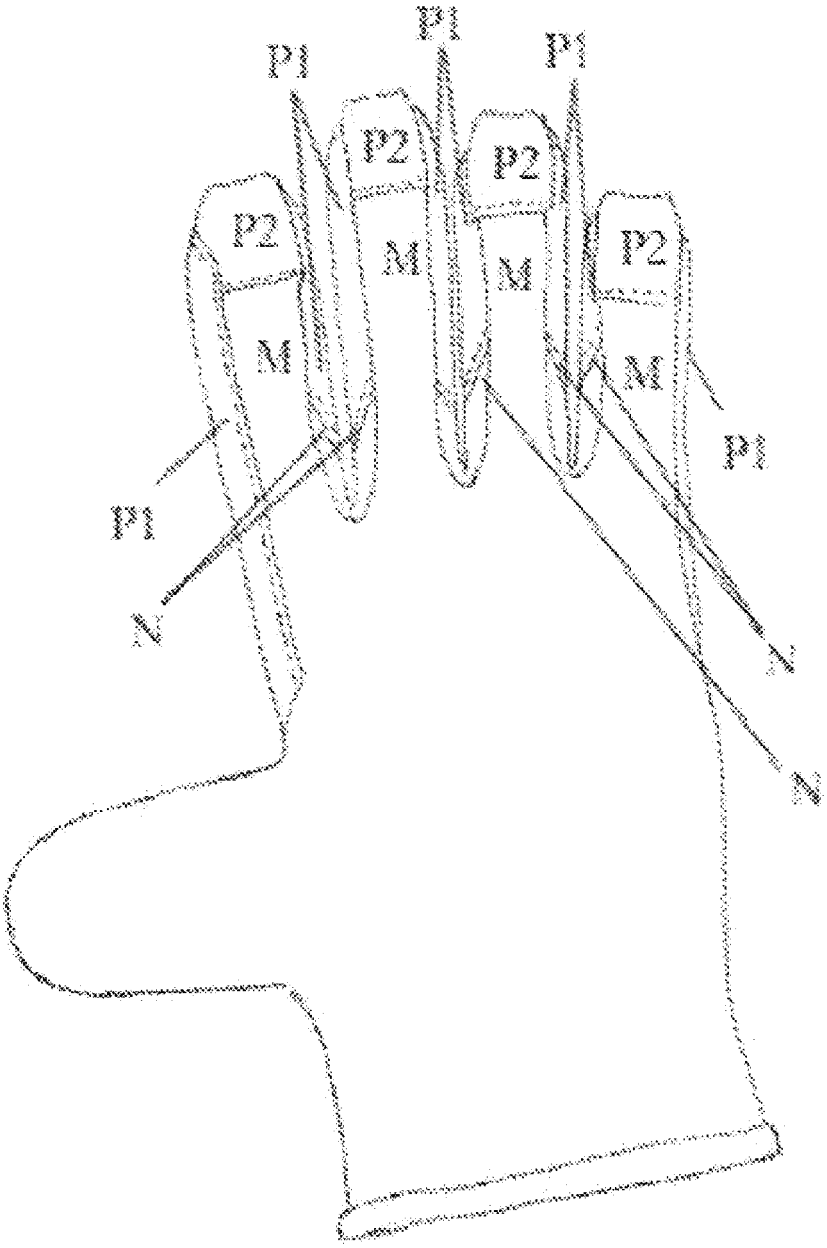
FIG. 18 is a back view of the right hand of the glove in one embodiment according to the present disclosure.
Figure 19:
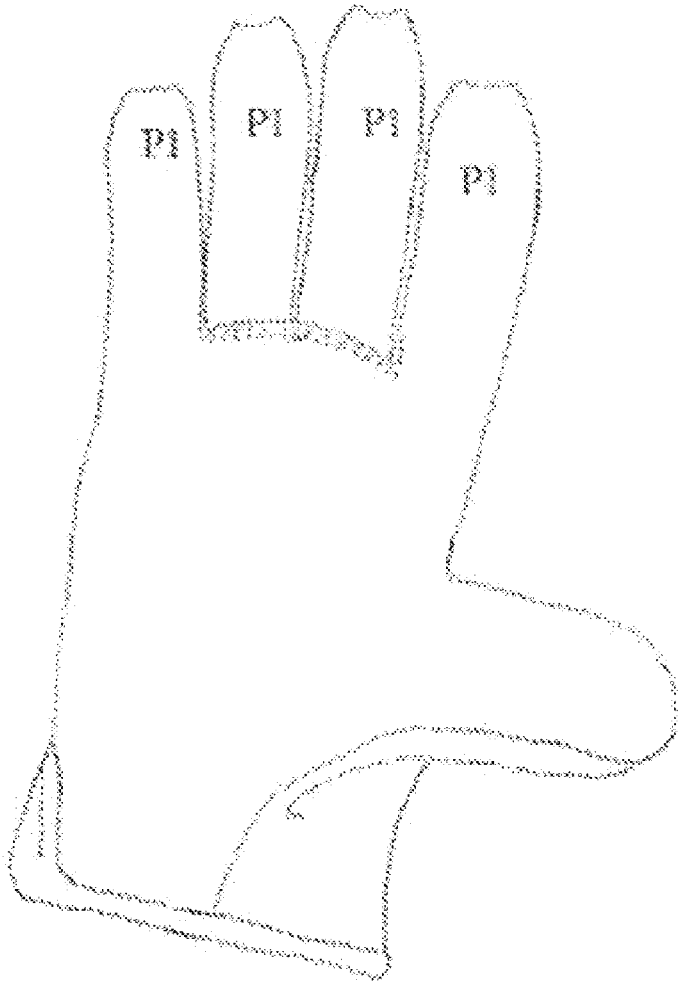
FIG. 19 is a palm view as shown in FIG. 18.

As shown in FIGS. 18 and 19, the embodiment also includes a second palm piece extending to the palm and connected to the first palm piece P1.

Wherein, optionally, the second palm piece and the first palm piece P1 are integrally formed. That is, in the embodiment, the second palm piece and the first palm piece P1 preferably adopts the same material sheet, which can reduce the seams, improve the comfort of use, etc. Of course, in the specific application, the second palm piece may be further sewn together with the first palm piece P1 using two pieces of material, in which the involved seam position is appropriate to be able to avoid the fingertip part.

Optionally, the embodiment also includes a second back seam piece extending to the back of the hand and connected to the first back seam piece (M).

Further preferably, the second back seam piece and the first back seam piece (M) are integrally formed, That is, in the embodiment, the second back seam piece and the first back seam piece M preferably adopts the same material sheet, which can reduce the seams, improve the comfort of use, etc. Of course, in the specific application, the second back seam piece may be further sewn together with the first back seam piece M using two pieces of material, with the seam location being adaptively selected based on actual conditions.

Furthermore, as shown in FIG. 18, in the embodiment, for better fit and breathability, it also includes a plurality of edge strips (N), of which each is adjacent to the finger fork of the glove finger.

It should be noted that for winter gloves or heavy-duty protective gloves, the above edge strips (N) may not be necessary.

It is important to note that although the embodiment only discloses the sewing of an independent finger as shown in FIGS. 13, 14, 15, 16, and 17, the same sewing mode is used for the other fingers. The fingertip palm material can be independent or connected to other parts of the glove palm material.

It is also to be noted that in traditional glove assembly, sewing is on the inside of the glove, so the assembly starts from the inside to the outside.

Step 1, cutting the glove palm first from a roll of material, where additional pieces of material may of course be added as needed;

Step 2, cutting/assembling the back of the glove from the material;

Step 3, sewing the sides of the fingers to the back of the glove, whereby the sides of each finger are sewn to the back of the glove along one side of the finger and the other side is free;

Step 4, sewing the glove palm to the overlocked edges along their free sides to bring the two halves of the glove together; a single continuous seam can be used to connect all fingers of the palm to all of the teeth and grooves. As this seam line wraps around the end of each finger, it joins the palm material and the back material of the glove together with a seam at the fingertips, and these seams are made in a flat plane where any turn thereof does not create a tight 180° turn.

Step 5, sewing the rest of the glove palm and back (areas other than the fingers) together; and Step 6, turning the glove out from the right side. In this way, the seams of the fingertips are angled inward.

However, in the embodiment, the fully enclosing fingertip is assembled as follows, and since all of the seams are on the inside of the glove, the glove is assembled with the inside facing out.

Step 1, cutting a surrounding piece of the glove from a roll of material, including the first palm pieces P1 and the back side pieces P2, to which additional pieces of material may be added; wherein the length of the finger part is significantly longer and wider than the finger part of the material of the glove back;

Step 2, cutting/assembling the first back seam pieces M from material;

Step 3, sewing the above-described surrounding piece and the first back seam piece together at the ends of their respective finger parts; these materials are joined with overlapping seams which do not point inwardly when the glove is turned over. Since the palm finger length of the glove is longer than the back finger length of the glove, the final fingertip position will contain only the first palm piece P1. The overlapping seams will be located on or behind the fingernail, lying flat against the skin. Since the width of the first palm piece P1 is the sum of the width of the back fingers of the glove plus the width of the sides of two fingers, the seams to the material on the back of the glove will be located only on the back of the glove fingers. No seams are presented on either side of the glove fingers.

Step 4, providing the side strips N as desired; prior to the finger fork parts of the fingers, no finger side strips N are presented at all. The side strips N adjacent to the finger fork parts are used for fit and breathability. For winter gloves or heavy-duty protective gloves, it is possible to have no finger side strips N at all.

Step 5, sewing the rest of the palm and the back of the glove (areas other than the fingers); and Step 6, turning the inside of the glove completely inside out.

By using the production technique, it avoids the drawbacks of traditional glove making, where there are no joints or overlapping seams at the fingertips.

In summary, compared to traditional glove manufacturing processes, where all the finger edge strips are sewn step by step to the finger parts at the back of the glove, and all the finger edge strips are sewn step by step to the glove palm, usually with a single seam line. The palm and back materials of the glove are joined at the fingertips with an inward seam, and all the seams are kept in the same plane. In the embodiment with the fully enclosing fingertip design, no side edge strips are presented at the fingertips. The surrounding piece and the first back seam pieces (M) are only met at the back of the finger, with no connection at the fingertips. The seams at the nails are overlapping seams, with the materials lying flat together, without any overlapping seams on the inside.

As a result, in the embodiment, the glove fingertips are designed to have a shape that conforms to the wearer's fingertip shape, and the traditional joint seams or finger side edge strips at the fingertips are eliminated.

In the description according to the present disclosure, terms such as "interconnected," "connected," and "fixed" should be broadly understood, such as fixed connections, detachable connections, or integrations; they can be mechanical or electrical connections, direct connections, or indirect connections through intermediate media, they can be internal connections of two components, or the interaction relationship between two components. For those skilled in the art, the specific meanings of these terms in the present disclosure can be understood based on specific circumstances.

In the present disclosure, unless otherwise specified and limited, the term "above" or "below" of the first feature with respect to the second feature may include direct contact between the first and second features, or indirect contact between them through other features. Furthermore, the first feature being "above", "over" and "on top of" the second feature includes the first feature being directly above and diagonally above the second feature, or simply indicating that the first feature is horizontally higher above the second feature. The first feature being "below", "under", and "beneath" the second feature includes the first feature being directly below and diagonally below the second feature, or simply indicating that the horizontal height of the first feature is less than the second feature.

In the description of the present embodiment, the terms "up", "down", "left", "right" and the like are used in the orientation or positional relationships based on the orientation or positional relationships shown in the figures. They are only intended to facilitate description and simplify operation, and are not intended to indicate or imply that the device or element referred to must have a particular orientation, be constructed and operated in a particular orientation, and therefore are not to be construed as a limitation of the present disclosure. Furthermore, the terms "first" and "second" are used only to distinguish in description and have no special meaning.

The above embodiments are only used to illustrate the technical solutions of the present disclosure without limitation, and the present disclosure is described in detail with reference to preferred embodiments. The person of ordinary skill in the art should understand that the technical solutions of the present disclosure may be modified or equivalently replaced without departing from the spirit and scope of the technical solutions of the present disclosure, and shall be covered by the scope of the claims of the present disclosure

What is claimed is:

1. A glove, comprising: a plurality of first palm pieces at fingertips of the glove, a plurality of rear side pieces at the fingertips of the glove and a plurality of first back seam pieces at the fingertips of the glove; wherein the first palm piece at each fingertip of the glove and the rear side piece at each fingertip of the glove are integrally formed;

the first palm piece at each fingertip of the glove and the rear side piece at each fingertip of the glove are sewn together at ends of their respective finger parts to form a three-dimensional structure, wherein each seam between the first palm piece at each fingertip of the glove and the rear side piece at each fingertip of the glove is provided on a nail or on a back of each finger; and wherein the first back seam piece at each fingertip of the glove is also sewn together with the first palm piece and the rear side piece at each fingertip of the glove, respectively.

2. The glove according to claim 1, wherein a set length of the first palm piece at each fingertip of the glove is greater than that of the first back seam piece at each fingertip of the glove, and a set width of the first palm piece at each fingertip of the glove is greater than that of the first back seam piece at each fingertip of the glove, respectively.

3. The glove according to claim 1, wherein a seam line of the first back seam piece at each fingertip of the glove with the first palm pieces at each fingertip of the glove and a seam line of the first back seam piece with the rear side pieces at each fingertip of the glove are both provided on the back of each finger.

4. The glove according to claim 1, wherein the first back seam pieces are made of stretchable material.

5. The glove according to claim 1, further comprising: a second palm piece extending to a palm part, wherein the second palm piece is connected to the plurality of first palm pieces.

6. The glove according to claim 5, wherein the second palm piece and the first palm pieces at each fingertip of the glove are integrally formed.

7. The glove according to claim 1, further comprising: a second back seam piece extending to a back of a hand, wherein the second back seam piece is connected to the first back seam pieces, respectively.

8. The glove according to claim 7, wherein the plurality of first back seam pieces and the second back seam piece are integrally formed.

9. The glove according to claim 1, wherein the first palm pieces at each fingertip of the glove have a first width at a position separated from each fingertip; a second width at a part corresponding to a position of each fingertip, where the second width is smaller than the first width; and a third width on the rear side piece at each fingertip of the glove at a position separated from each fingertip, where the third width is smaller than the first width.

* * * * *